US009469009B1

(12) United States Patent
Kazimierczuk

(10) Patent No.: US 9,469,009 B1
(45) Date of Patent: Oct. 18, 2016

(54) ADJUSTABLE TOOL HOLDING SURFACE GRINDER FIXTURE

(71) Applicant: Andrzej Kazimierczuk, Lake Havasu City, AZ (US)

(72) Inventor: Andrzej Kazimierczuk, Lake Havasu City, AZ (US)

( * ) Notice: Subject to any disclaimer, the term of this patent is extended or adjusted under 35 U.S.C. 154(b) by 0 days.

(21) Appl. No.: 15/016,804

(22) Filed: Feb. 5, 2016

(51) Int. Cl.
*B24B 3/24* (2006.01)

(52) U.S. Cl.
CPC ..... *B24B 3/247* (2013.01)

(58) Field of Classification Search
CPC ..... B24B 3/247; B24B 3/28; B24B 3/26; B24B 3/32; B24B 41/066
USPC ..... 451/375
See application file for complete search history.

(56) References Cited

U.S. PATENT DOCUMENTS 302,726 A * 7/1884 Hand ..... B24B 3/247 279/114
388,784 A * 8/1888 Mossberg ..... B24B 3/247 451/226
2,486,335 A * 10/1949 Smith ..... B24B 3/247 451/375
2,690,037 A * 9/1954 Meyer ..... B24B 3/00 451/374
2,710,498 A * 6/1955 Rocheleau ..... B24B 41/066 451/374
2,767,531 A * 10/1956 Keller ..... B24B 41/066 451/369
3,374,587 A * 3/1968 Simpkins ..... B24B 3/247 451/375
3,447,271 A * 6/1969 Neeb ..... B24B 3/06 451/374
3,808,748 A * 5/1974 Gunnerson ..... B24B 3/247 451/375
5,649,853 A * 7/1997 Kuo ..... B24B 3/30 451/178
6,676,494 B1 * 1/2004 Ching ..... B24B 3/247 451/231
7,488,238 B2 * 2/2009 Liao ..... B24B 3/26 451/234
7,959,494 B1 * 6/2011 Pietrzak ..... B24B 3/52 451/293
8,801,501 B2 * 8/2014 Worthington ..... B24B 3/48 30/35
2007/0218819 A1 * 9/2007 Schwaiger ..... B24B 3/00 451/371
2007/0232208 A1 * 10/2007 Liu ..... B24B 3/26 451/375
2009/0004956 A1 * 1/2009 Smith ..... B24B 3/38 451/371

* cited by examiner

*Primary Examiner* — George Nguyen
(74) *Attorney, Agent, or Firm* — Crossley & Stevenson Intellectual Property Law

(57) ABSTRACT

An adjustable tool holding surface grinder fixture securing a collet holder for holding one of a plurality of metal cutting tools, such a drill bit, on a base which slides directly adjacent a surface grinder. A rotatable fixture mount, disposed on a vertical wall at a right angle on the base, is adjustable at various pre-set angles via the alignment of positioning holes on the fixture mount and adjustment holes on the vertical wall to secure the collet holder for sharpening the cutting tool at varying angles relative the surface grinder. Several clamping screws are provided to secure the collet holder on the base.

4 Claims, 6 Drawing Sheets

ADJUSTABLE TOOL HOLDING SURFACE GRINDER FIXTURE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of sharpening and grinding devices are provided for sharpening the cutting edges of metal cutting tools are known in the prior art. However, what is needed is an adjustable tool holding surface grinder fixture securing a collet holder for holding one of a plurality of metal cutting tools, such a drill bit, on a base which slides directly adjacent a surface grinder.

FIELD OF THE INVENTION

The present invention relates to sharpening and grinding devices for sharpening the cutting edges of metal cutting tools, and more particularly, to an adjustable tool holding surface grinder fixture.

SUMMARY OF THE INVENTION

The general purpose of the present adjustable tool holding surface grinder fixture, described subsequently in greater detail, is to provide an adjustable tool holding surface grinder fixture which has many novel features that result in an adjustable tool holding surface grinder fixture which is not anticipated, rendered obvious, suggested, or even implied by prior art, either alone or in combination thereof.

To accomplish this, the present adjustable tool holding surface grinder fixture is used in connection with a surface grinder to sharpen a variety of metal cutting tools, such as a drill bit, countersink, counterbore, reamers, and making and sharpening various end mills. The present device includes a parallelepiped base having front and rear portions. A set-up angle pin is provided to secure a collet holder at a desired angle. A cylindrical stud member, vertically disposed on a top side of the front portion proximal each of the front and left sides, has threaded opening. A threaded first clamping screw engages the threaded opening and has a rotatable first cap on a posterior end thereof. A central groove, centrally disposed on the front portion top side proximal the stud member in a position parallel to the front side, has an open end on the left side and a closed end centrally disposed in the front portion on the top side. A forward movement stop pin is vertically disposed within the central groove proximal the closed end. Second and third grooves are also disposed in the top side parallel to on each side of the central groove and have a cylindrical rod continuously disposed therein, which partially protrude upwardly therefrom. The rods assist in alignment of the collet holder on the base.

A cylindrical aligned pair of side movement stop pins is vertically disposed on the front portion top side proximal to and parallel to the third groove in a position more proximal the rear side than the third groove. A substantially parallelepiped stop wall is vertically disposed on the front portion top side proximal the front side and the right side and perpendicular to the central groove and further parallel to the base right side. The stop wall has a top wall and a front wall, and a decreasing sloped wall is disposed between the top wall and the front wall. A support wall, vertically disposed on the rear portion top side directly adjacent the rear side, includes a plurality of adjustment holes disposed on an external surface thereof in a semi-circular configuration proximal the right wall, initiating proximal the upper wall and terminating proximal the bottom edge.

A rotatable fixture mount, disposed on an internal surface of the support wall, includes a rotatable mount disc which rotatably engages the internal surface and an O-ring between the mount disc interior surface and the internal surface. A curved adjustment slot is disposed on the exterior surface in alignment with a portion of an external perimeter of the mount disc. An adjustment screw, disposed within the adjustment slot, is provided to permit the mount disc to rotate. A pair of positioning holes, disposed through the mount disc proximal the external perimeter, include a first positioning hole and a second positioning hole, which are alignable with the adjustment holes to adjust the angle of the collet holder relative the base.

An L-shaped collet support fixture has a parallelepiped member fixedly disposed on the exterior surface of the mount disc between the positioning holes in a position perpendicular to the exterior surface and a parallelepiped arm disposed on an external end of the member in a position perpendicular to the member. A threaded second clamping screw threadingly engages an exterior end of the arm and has a rotatable second cap on a distal end thereof. A parallelepiped mount bar is disposed on the mount disc exterior surface directly adjacent the member of the collet support fixture in a position perpendicular to the member. The mount bar has an exterior end disposed between the first positioning hole and the first end of the adjustment slot and an interior end disposed proximal the second end of the adjustment slot. The mount bar has a longitudinal fourth groove disposed on an external face proximal the adjustment slot. A cylindrical bar is continuously disposed within the fourth groove. A cylindrical third stop pin is vertically disposed on the exterior surface of the mount disc proximal the second end of the adjustment slot in a position proximal the external perimeter. A cylindrical sine bar pin is vertically disposed on the exterior surface of the mount disc proximal the third stop pin and is disposed more proximal the mount bar than the third stop pin. At least one collet holder is provided to accommodate an insertable collet. The collet holder is removably securable between the exterior surface of the mount disc, the mount bar, and the top side of the base.

The present device reduces the frequency with which tools must be replaced because the tools can be sharpened rather than discarded. The base preferably has a width of 4 inches a length of 4⅝ inches and a height of ½ inch. The support wall preferably has a height and a length of 4 inches and a width of ½ inch. The collet holder preferably accommodates a 5 C collet. Thus has been broadly outlined the more important features of the present adjustable tool holding surface grinder fixture so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
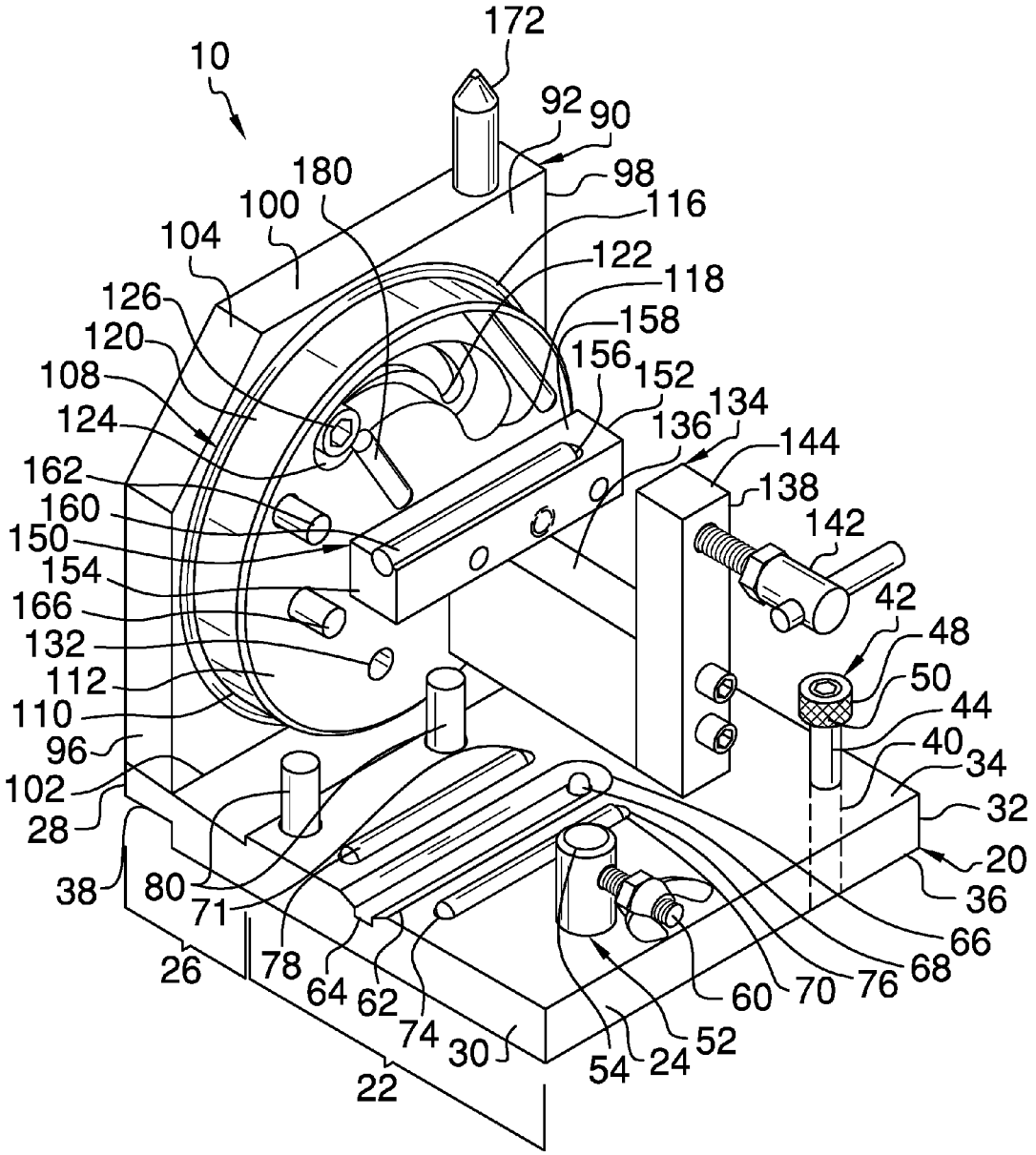
FIG. 1 is a front isometric view.
Figure 2:
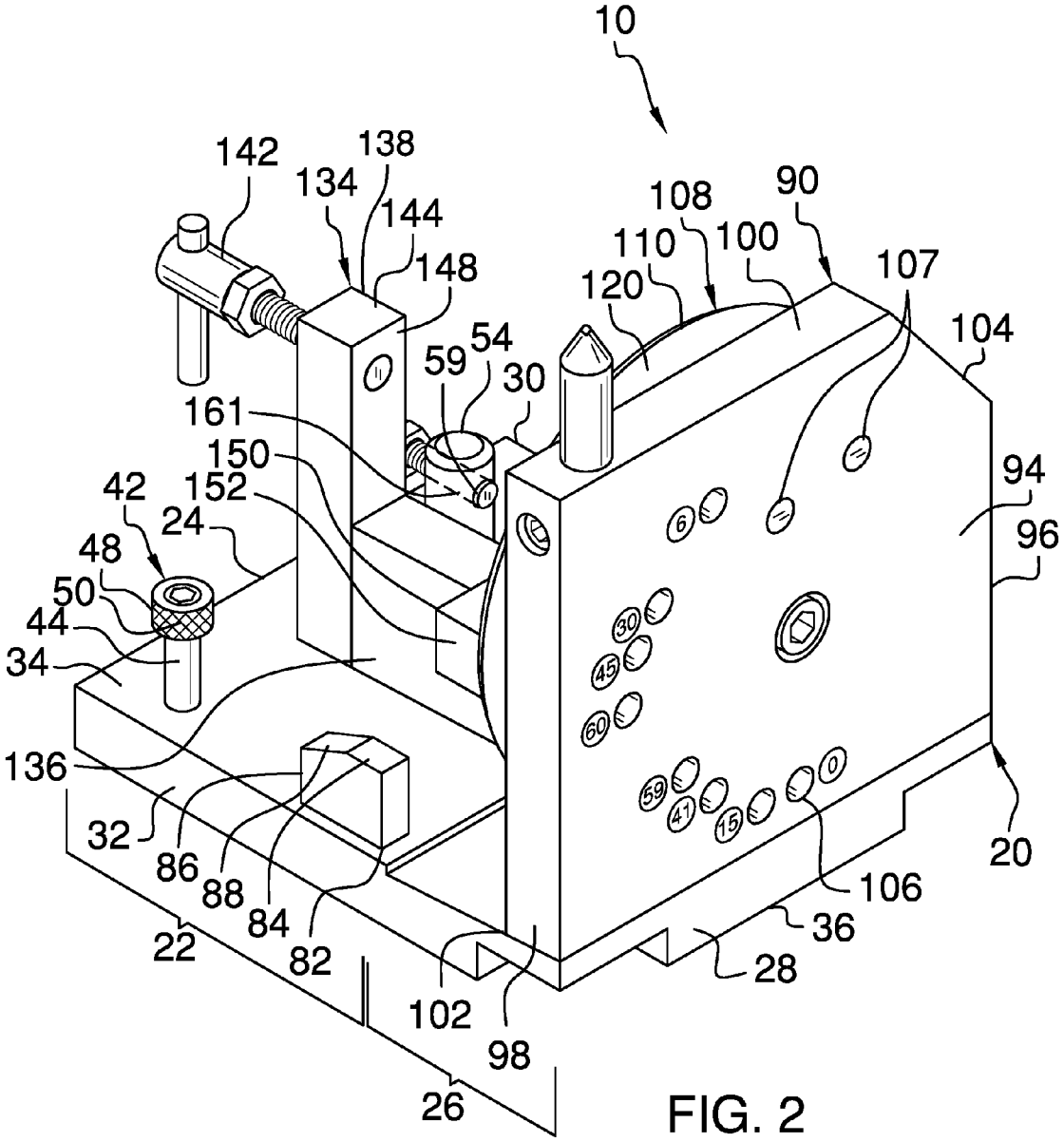
FIG. 2 is a rear isometric view.
Figure 3:
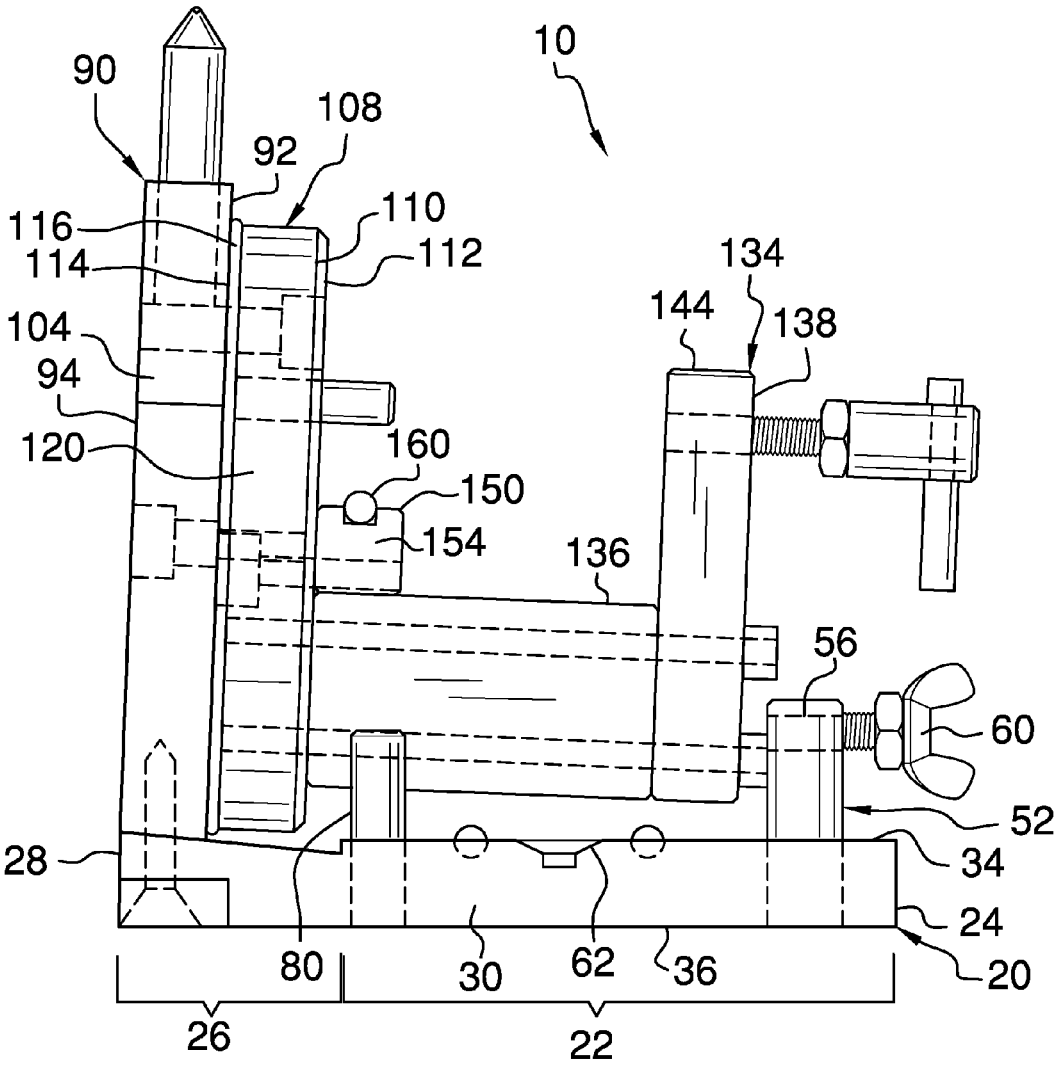
FIG. 3 is a side view.
Figure 4:
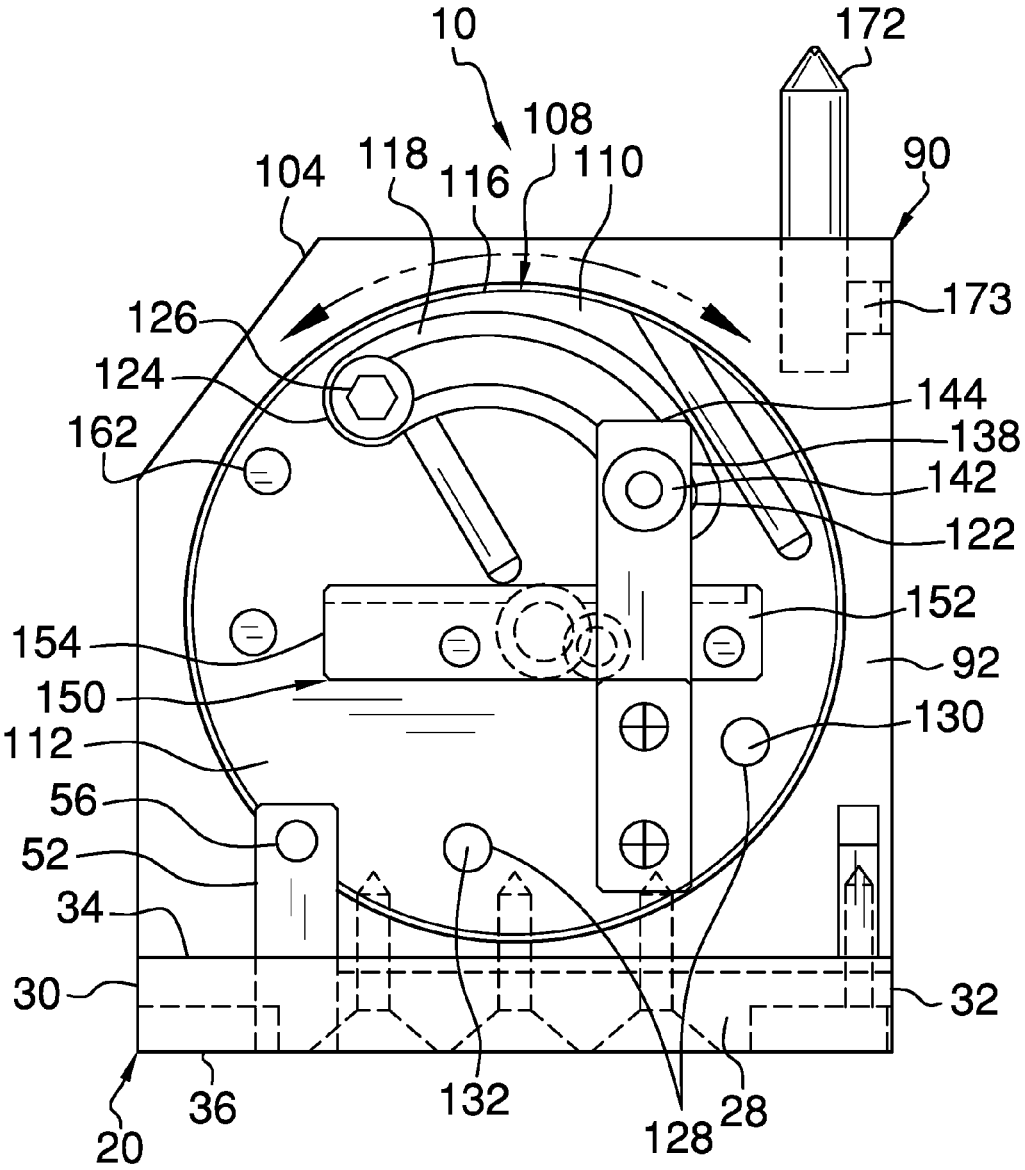
FIG. 4 is a front view.
Figure 5:
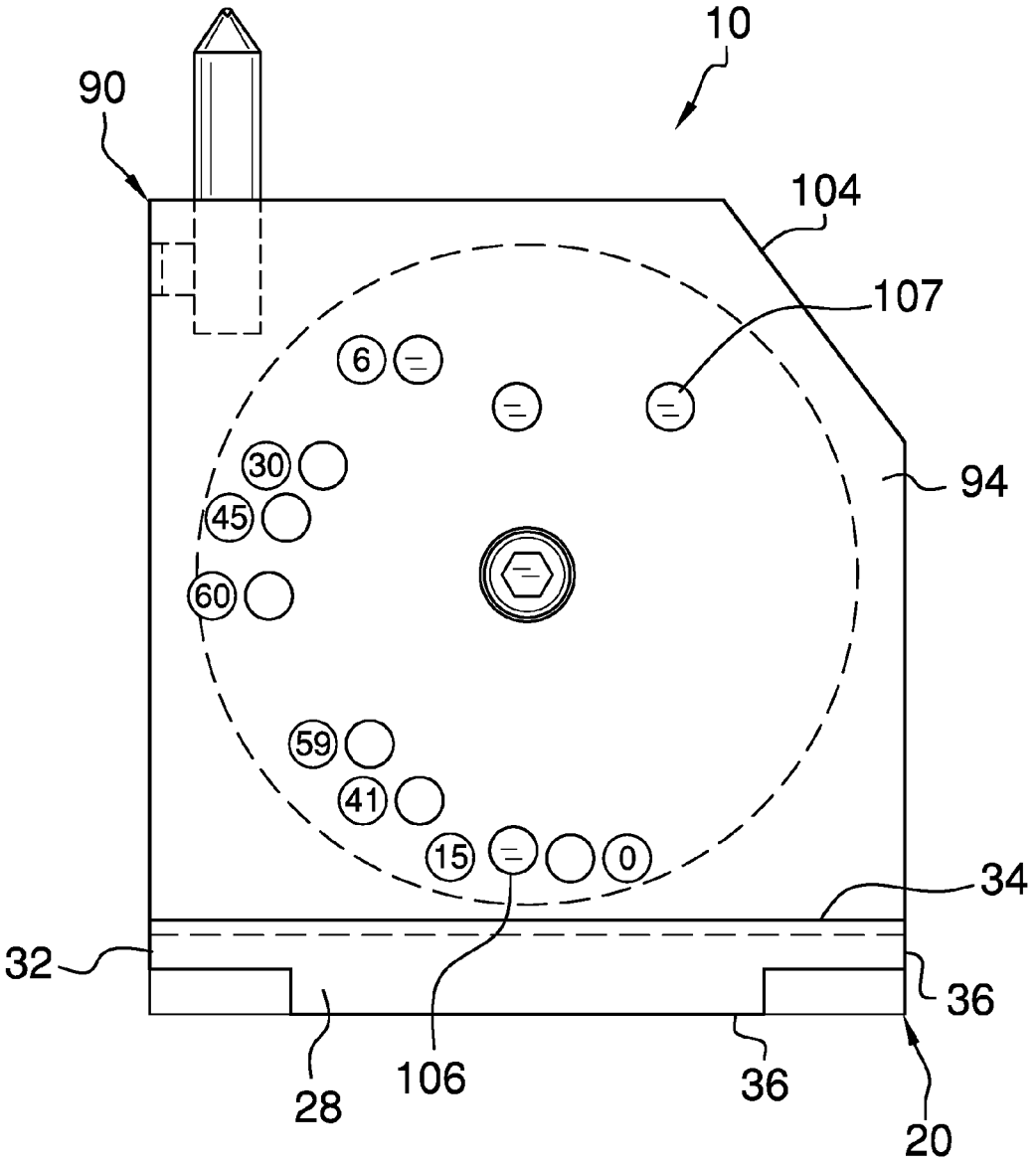
FIG. 5 is a rear view.
Figure 6:
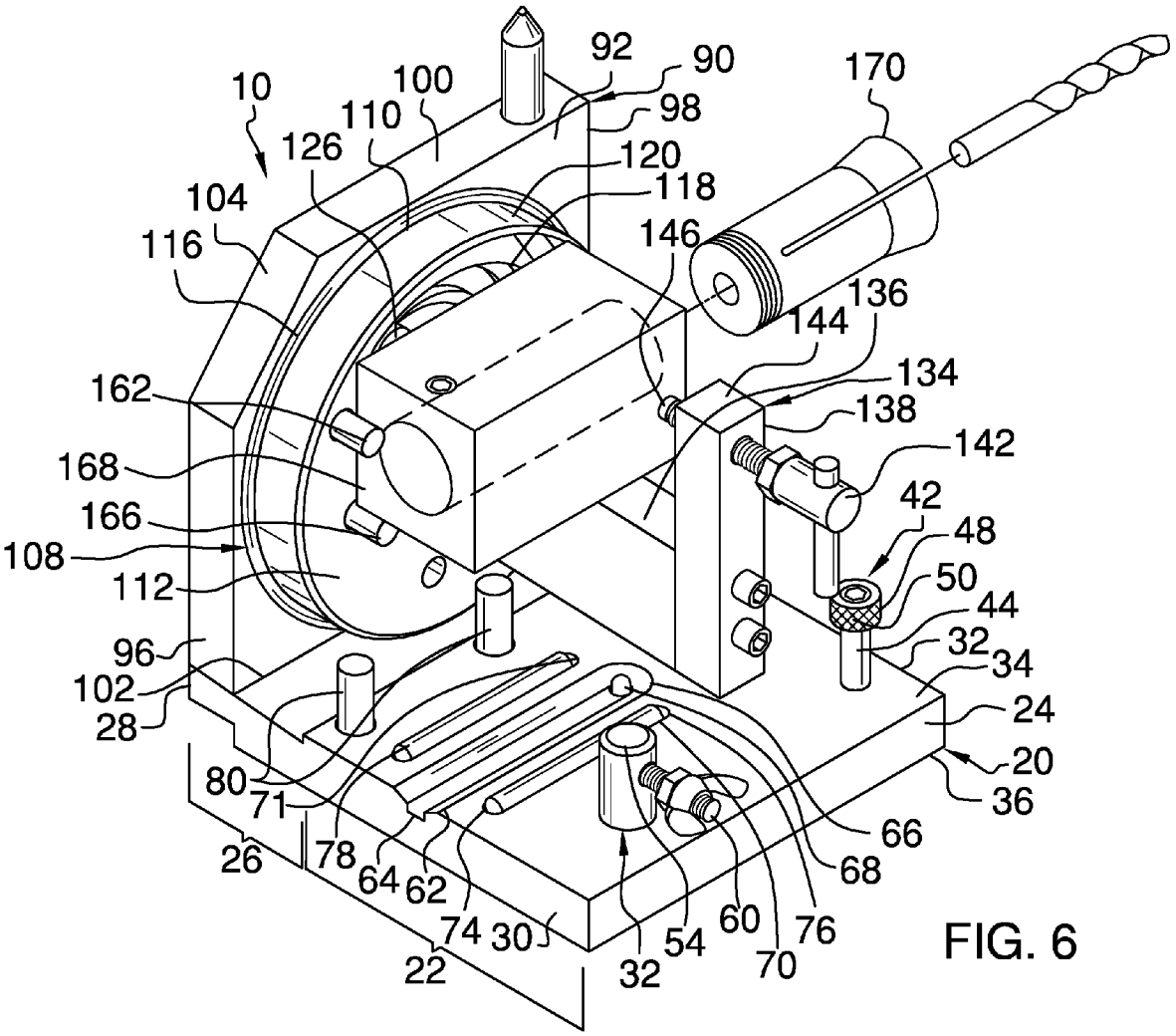
FIG. 6 is an in-use view.

With reference now to the drawings, and in particular FIGS. 1 through 6 thereof, an example of the instant adjustable tool holding surface grinder fixture employing the principles and concepts of the present adjustable tool holding surface grinder fixture and generally designated by the reference number 10 will be described.

Referring to FIGS. 1 through 6, the present adjustable tool holding surface grinder fixture 10 for securing a collet holder, which holds one of a plurality of metal cutting tools, such a drill bit, on a base which slides directly adjacent a surface grinder is illustrated. The adjustable tool holding surface grinder fixture 10 includes a parallelepiped base 20 having a front portion 22 having a front side 24 and a rear portion 26 having a rear side 28. Each of the front side 24 and the rear side 28 has a left side 30, a right side 32, a top side 34, and a bottom side 36. The top side 34 of the rear portion 26 is lower than the top side 34 of the front portion 22 relative the bottom side 36. An angled notch 38 is disposed on the rear portion 26 bottom side 36 proximal each of the left side 30 and the right side 32.

A vertically disposed storage aperture 40 is disposed through the base 20 front portion 22 proximal the right side 32 and the front side 24 of the base. A set-up angle pin 42 engages the storage aperture 40. The set-up angle pin 42 has a cylindrical bottom portion 44 disposed on the top side 34 and an annular top portion 48 disposed atop the bottom portion 44. The annular top portion 48 has a continuous diamond grained outer surface 50. A cylindrical stud member 52 is vertically disposed on the top side 34 of the front portion 22 proximal each of the front side 24 and the left side 30. The stud member 52 has a beveled upper edge 54 and a threaded opening 56 disposed proximal the upper edge 58 in a position parallel to the top side 34. A threaded first clamping screw 60 engages the threaded opening 56. The first clamping screw 60 has a rotatable first cap 59 on a posterior end 61 thereof.

A central groove 62 is centrally disposed on the front portion 22 top side 34 proximal the stud member 52 in a position parallel to each of the front side 24 and the rear side 28. The central groove 62 has an open end 64 disposed on the left side 30 and a closed end 66 centrally disposed in the front portion 22 on the top side 34. A forward movement stop pin 68 is vertically disposed within the central groove 62 proximal the closed end 66. A second groove 70 is disposed in the front portion 22 top side 34 parallel to and proximal to the central groove 62 in a position more proximal the front side 34 than the central groove 62. A third groove 71 is disposed in the front portion 22 top side 34 parallel to and proximal to the central groove 62 in a position more proximal the rear side 28 than the central groove 62. Each of the second groove 70 and the third groove 71 has an external closed end 74 proximal the left side 30 and an internal closed end 76 disposed proximal the forward movement stop pin 68. Each of the second groove 70 and the third groove 71 has a length shorter than a length of the central groove 62. A cylindrical rod 78 is continuously disposed in each of the second groove 70 and the third groove 71 and partially protrudes upwardly from the respective second groove 70 and third groove 71.

A cylindrical aligned pair of side movement stop pins 80 is vertically disposed on the front portion 22 top side 34 proximal and parallel the third groove 71. The pair of side movement stop pins 80 is more proximal the rear side 28 than the third groove 71. A substantially parallelepiped stop wall 82 is vertically disposed on the front portion 22 top side 34 proximal the front side 24 and the right side 32 and perpendicular to the central groove 62 and further parallel to the base right side 32. The stop wall 82 has a top wall 84, a front wall 86, and a decreasing sloped wall 88 disposed between the top wall 84 and the front wall 86.

A support wall 90 is vertically disposed on the rear portion 26 top side 34 directly adjacent the rear side 28. The support wall 90 has an internal surface 92, an external surface 94, a left wall 96, a right wall 98, an upper wall 100, a bottom edge 102, and a 45-degree decreasing pre-set angled wall 104 disposed between the upper wall 100 and the left wall 96. A plurality of adjustment holes 106 is disposed on the external surface 94 in a semi-circular configuration proximal the right wall 98. The configuration initiates proximal the upper wall 100 and terminates proximal the bottom edge 102. A pair of tap holes 107 is centrally disposed between the upper wall 100 and a center of the support wall 90.

A rotatable fixture mount 108 is disposed on the internal surface 92. The rotatable fixture mount 108 includes a rotatable mount disc 110 which rotatably engages the internal surface 92. The mount disc 110 has an interior surface 112 and an exterior surface 114. An O-ring 116 is disposed between the mount disc 110 interior surface 112 and the support wall 90 internal surface 92. A curved adjustment slot 118 is disposed on the exterior surface 114 in alignment with a portion of an external perimeter 120 of the mount disc 110. The adjustment slot 118 has a first end 122 and a second end 124 opposite the first end 122. An adjustment screw 126 is disposed within the adjustment slot 118 and engages one of the tap holes 107. The adjustment screw 126 has a loosened condition and an alternate tightened condition. The mount disc 110 is rotatable relative the support wall 90 when the adjustment screw 126 is in the loosened condition. A pair of positioning holes 128 is disposed through the mount disc 110 proximal the external perimeter 120, the positioning holes 128 comprise a first positioning hole 130 disposed proximal the first end 122 and a second positioning 132 hole disposed proximal the external perimeter 120 opposite the second end 124. When the adjustment screw 126 is in the loosened condition, one of the positioning holes 128 is alignable with one of the adjustment holes 106. Upon the alignment of one of the positioning holes 128 with one of the adjustment holes 106, the set-up angle pin 42 is insertable through the respective aligned adjustment hole 106 and positioning hole 128.

An L-shaped collet support fixture 134 has a parallelepiped member 136 fixedly disposed on the exterior surface 114 of the mount disc 110 between the positioning holes 128 in a position perpendicular to the exterior surface 114 and a parallelepiped arm 138 disposed on an external end 140 of the member 136 in a position perpendicular to the member 136. A threaded second clamping screw 142 threadingly engages an exterior end of the arm 144. The second clamping screw 142 has a rotatable second cap 146 on a distal end 148 thereof. A parallelepiped mount bar 150 is disposed on the mount disc 110 exterior surface 114 directly adjacent the member 136 of the collet support fixture 134 in a position perpendicular to the member 136. The mount bar 150 has an exterior end 152 disposed between the first positioning hole 130 and the first end of the adjustment slot 122 and an interior end 154 disposed proximal the second end of the adjustment slot 124. The mount bar 150 has a longitudinal fourth groove 156 disposed on an external face 158 proximal the adjustment slot 118. A cylindrical bar 160 is continuously disposed within the fourth groove 156. A cylindrical third stop pin 162 is vertically disposed on the exterior surface 114 of the mount disc 110 proximal the second end 124 of the adjustment slot 118 in a position proximal the external perimeter 120. A cylindrical sine bar 166 pin is vertically disposed on the exterior surface 114 of the mount disc 110 proximal the third stop pin 162. The sine bar pin 166 is disposed more proximal the mount bar 150 than the third stop pin 162. The sine bar 166 is configured to be employed for making form tools.

At least one collet holder 168 with an insertable collet 170 is secured by the device 10. The collet holder 170 is removably securable between the exterior surface 114 of the mount disc 110, the mount bar 150, and the top side 34 of the base 20. Upon insertion of the respective one of the at least one collet holder 168 between the stud member 52 and the side movement stop pins 80 and the stabilization of a forward end of the respective one of the least one collet holder 168 against the forward movement stop pin 68, a front edge of a metal cutting tool is alignable with one of the top wall 84 and the decreasing sloped wall 88. Upon insertion of the set-up angle pin 42 through the respective aligned adjustment hole 106 and positioning hole 128, the collet support fixture 134 is secured at one of a plurality of pre-set angles relative the base 20. Upon insertion of the collet 170 into the collet holder 168 when the collet support fixture 134 is secured at the one of the plurality of the pre-set angles relative the base 20, an edge of a metal cutting tool is set at a respective angle relative a grinding wheel of a surface grinder.

The adjustable tool holding surface grinder fixture 10 also includes a diamond dresser 172 vertically disposed on the upper wall 100 of the support wall 90. A set screw 173 secures the diamond dresser 172 in place onto the support wall 90.

The adjustable tool holding surface grinder fixture 10 further includes a pair of cylindrical fixture rollers 180 partially embedded into the interior surface 112 of the mount disc 110. The fixture rollers 180 are parallel to each other. One fixture roller 180 is disposed on each of a side of the adjustment slot 118.

What is claimed is:

1. An adjustable tool holding surface grinder fixture comprising:

a parallelepiped base having a front portion having a front side and a rear portion having a rear side, each of the front side, and the rear side having a left side, a right side, a top side, and a bottom side, the top side of the rear portion being lower than the top side of the front portion relative the bottom side;

an angled notch disposed on the rear portion bottom side proximal each of the left side and the right side;

a set-up angle pin having a cylindrical bottom portion disposed on the top side and an annular top portion, the annular top portion having a continuous diamond grained outer surface;

a cylindrical stud member vertically disposed on the top side of the front portion proximal each of the front side and the left side, the stud member having a beveled upper edge and a threaded opening disposed proximal the upper edge in a position parallel to the top side;

a threaded first clamping screw engaging the threaded opening, the first clamping screw having a rotatable first cap on a posterior end thereof;

a central groove centrally disposed on the front portion top side proximal the stud member in a position parallel to each of the front side and the rear side, the central groove having an open end disposed on the left side and a closed end centrally disposed in the front portion on the top side;

a forward movement stop pin vertically disposed within the central groove proximal the closed end;

a second groove disposed in the front portion top side parallel to and proximal to the central groove in a position more proximal the front side than the central groove;

a third groove disposed in the front portion top side parallel to and proximal to the central groove in a position more proximal the rear side than the central groove, each of the second groove and the third groove having an external closed end proximal the left side and an internal closed end disposed proximal the forward movement stop pin, each of the second groove and the third groove having a length shorter than a length of the central groove;

a cylindrical rod continuously disposed in each of the second groove and the third groove, the rod partially protruding upwardly from the respective second groove and third groove;

a cylindrical aligned pair of side movement stop pins vertically disposed on the front portion top side proximal and parallel the third groove, the pair of side movement stop pins being more proximal the rear side than the third groove;

a substantially parallelepiped stop wall vertically disposed on the front portion top side proximal the front side and the right side and perpendicular to the central groove and further parallel to the base right side, the stop wall being more proximal the rear side than the set-up angle pin, the stop wall having a top wall and a front wall, and a decreasing sloped wall disposed between the top wall and the front wall;

a support wall vertically disposed on the rear portion top side directly adjacent the rear side, the support wall having an internal surface, an external surface, a left wall, a right wall, an upper wall, a bottom edge, a 45-degree decreasing pre-set angled wall disposed between the upper wall and the left wall;

a plurality of adjustment holes disposed on the external surface in a semi-circular configuration proximal the right wall, the configuration initiating proximal the upper wall and terminating proximal the bottom edge;

a pair of tap holes centrally disposed between the upper wall and a center of the support wall;

a rotatable fixture mount disposed on the internal surface, the rotatable fixture mount comprising:

a rotatable mount disc rotatably engaging the internal surface, the mount disc having an interior surface and an exterior surface;

an O-ring disposed between the mount disc interior surface and the support wall internal surface;

a curved adjustment slot disposed on the exterior surface in alignment with a portion of an external perimeter of the mount disc, the adjustment slot having a first end and a second end opposite the first end;

an adjustment screw disposed within the adjustment slot and engageable with one of the pair of tap holes, wherein the adjustment screw has a loosened condition and an alternate tightened condition, wherein the mount disc is rotatable relative the support wall when the adjustment screw is in the loosened condition;

a pair of positioning holes disposed through the mount disc proximal the external perimeter, the positioning holes comprising a first positioning hole disposed proximal the first end and a second positioning hole disposed proximal the external perimeter opposite the second end, wherein when the adjustment screw is in the loosened condition, one of the positioning holes is alignable with one of the adjustment holes, wherein upon the alignment of one of the positioning holes with one of the adjustment holes, the set-up angle pin is insertable through the respective aligned adjustment hole and positioning hole;

an L-shaped collet support fixture having a parallelepiped member fixedly disposed on the exterior surface of the mount disc between the positioning holes in a position perpendicular to the exterior surface and a parallelepiped arm disposed on an external end of the member in a position perpendicular to the member;

a threaded second clamping screw threadingly engaging an exterior end of the arm, the second clamping screw having a rotatable second cap on a distal end thereof;

a parallelepiped mount bar disposed on the mount disc exterior surface directly adjacent the member of the collet support fixture in a position perpendicular to the member, the mount bar having an exterior end disposed between the first positioning hole and the first end of the adjustment slot and an interior end disposed proximal the second end of the adjustment slot, the mount bar having a longitudinal fourth groove disposed on an external face proximal the adjustment slot;

a cylindrical bar continuously disposed within the fourth groove;

a cylindrical third stop pin vertically disposed on the exterior surface of the mount disc proximal the second end of the adjustment slot in a position proximal the external perimeter;

a cylindrical sine bar pin vertically disposed on the exterior surface of the mount disc proximal the third stop pin, the sine bar pin being disposed more proximal the mount bar than the third stop pin;

at least one collet holder having an insertable collet, the collet holder removably securable between the exterior surface of the mount disc, the mount bar, and the top side of the base;

wherein upon insertion of the respective one of the least one collet holder between the stud member and the side movement stop pins and the stabilization of a forward end of the respective one of the least one collet holder against the forward movement stop pin, a front edge of a metal cutting tool is alignable with one of the top wall and the decreasing sloped wall;

wherein upon insertion of the set-up angle pin through the respective aligned adjustment hole and positioning hole, the collet support fixture is secured at one of a plurality of pre-set angles relative the base; and wherein upon insertion of the collet into the collet holder when the collet support fixture is secured at the one of the plurality of the pre-set angles relative the base, an edge of a metal cutting tool is set at a respective angle relative a grinding wheel of a surface grinder.

2. The adjustable tool holding surface grinder fixture of claim 1 comprising a vertically disposed storage aperture disposed through the base front portion proximal the right side and the front side of the base.

3. The adjustable tool holding surface grinder fixture of claim 1 comprising a diamond dresser vertically disposed on the upper wall of the support wall.

4. The adjustable tool holding surface grinder fixture of claim 1 comprising a pair of cylindrical fixture rollers partially embedded into the interior surface of the mount disc, the fixture rollers being parallel to each other, one fixture roller being disposed on each of a side of the adjustment slot.

* * * * *